US005595219A

United States Patent [19]

Deuel et al.

[11] Patent Number: 5,595,219

[45] Date of Patent: Jan. 21, 1997

[54] APPARATUS AND METHOD FOR SPLAYING THE SHIELD WIRES OF A COAXIAL CABLE

[75] Inventors: Gregory F. Deuel, Lancaster; Marlin R. Schollenberger, Myerstown, both of Pa.

[73] Assignee: The Whitaker Corporation, Wilmington, Del.

[21] Appl. No.: 347,638

[22] Filed: Dec. 1, 1994

[51] Int. Cl.[6] ..... B21F 45/00

[52] U.S. Cl. ..... 140/123; 29/828

[58] Field of Search ..... 29/461, 828; 140/106, 140/123

[56] References Cited

U.S. PATENT DOCUMENTS 4,719,697 1/1988 Schwartzman et al. ..... 29/828

FOREIGN PATENT DOCUMENTS

4027904A1 3/1992 Germany .
WO87/05752 9/1987 WIPO .

*Primary Examiner*—Lowell A. Larson

[57] ABSTRACT

An apparatus (40) and method of use is disclosed for splaying the cut end of a wire shield (18) during termination of a coax cable assembly (10). The apparatus includes a block (42) having a flat surface (44) and a first hole (48) formed through the flat surface and into the block. A pin (52) is disposed in the first hole and is slidable therein. An end (60) of the pin extends out of the first hole (48) and is spring biased in that direction. A second hole (78) is formed axially through the pin and is sized to receive the insulated center conductor (20) of the cable assembly (10). A third hole (82) is formed in the block (42) and is arranged for receiving the prepared end of the center conductor (20) for initial splaying of the wire shield (18) by shifting the cable assembly off center to the third hole (82) and then moving it in an arcuate path about the axis of the hole. The center conductor is then removed from the third hole and inserted into the second hole (78) in the pin (52), causing the pin to engage the partially splayed wire shield (18) and to further splay it as the pin retracts into the first hole (48).

9 Claims, 5 Drawing Sheets

APPARATUS AND METHOD FOR SPLAYING THE SHIELD WIRES OF A COAXIAL CABLE

The present invention relates to the termination of coax cable and more particularly to the preparation of the end of the cable for termination to the shield conductor.

BACKGROUND OF THE INVENTION

When terminating the end of a coax cable, one of the most difficult and time consuming aspects is the proper splaying of the wire shield preparatory to its termination to a ground contact. In such a terminating process the crimping ferrule is usually slipped over the cable, the end of the cable stripped, the center conductor terminated, and then the wire shield terminated to the ferrule and a ground shell. Since the wire shield is usually wedged between the crimping ferrule and the ground shell, the wire shield must first be splayed outwardly so that the ground shell can be slipped over the insulated center conductor and under the wire shield prior to crimping. The splaying operation is usually accomplished manually by using tweezers to grasp portions of the wire shield and pull them outwardly in a somewhat fan shape, working around the circumference of the cable until all of the portions of the wire shield are disposed radially outwardly, approximately normal to the axis of the cable. A portion of the insulation of the insulated center conductor is stripped as desired to bare the center conductor for later termination to a contact. The ground shell is then slipped over the insulated center conductor and abutted against the splayed wire shield. The wire shield is then folded down over the shank of the ground shell and the ferrule slid over the shank with the wire shield wedged in between and crimped. This is an inefficient and tedious operation resulting in varying levels of quality, depending in part on the individual doing the work.

What is needed is a tool and method of using that assures a repeatable high quality wire shield splaying that is inexpensive and simple to perform.

SUMMARY OF THE INVENTION

A tool is disclosed for splaying the wire shielding of a coax cable radially about its center conductor. The cable has a prepared end stripped of insulation. The tool includes a block having a flat surface and a first hole formed in the flat surface perpendicular thereto. A pin is disposed in the first hole and arranged to slide therein from a first position where an end of the pin extends outwardly from the flat surface to a second position where the end of the pin is substantially flush with the flat surface. The pin has a second hole formed axially therein for receiving the center conductor of the cable. A resilient member is arranged in the first hole for urging the pin into the first position. Whereby, upon moving the coax cable axially toward the pin, the pin being in the first position, and insertion of the center conductor into the second hole, the wire shield engages the end of the pin and splays outwardly. Then, the pin retracts into the block against the urging of the resilient member under continued movement of the cable until the wire shield engages the flat surface and is thereby splayed further, the pin then being in the second position.

DESCRIPTION OF THE PREFERRED EMBODIMENT

Figure 1:
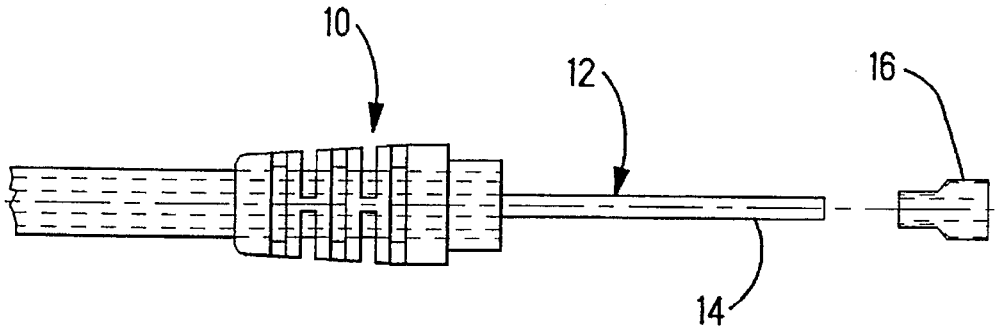
FIG. 1 is a side view of a typical coax cable assembly prior to preparation for termination.
Figure 2:
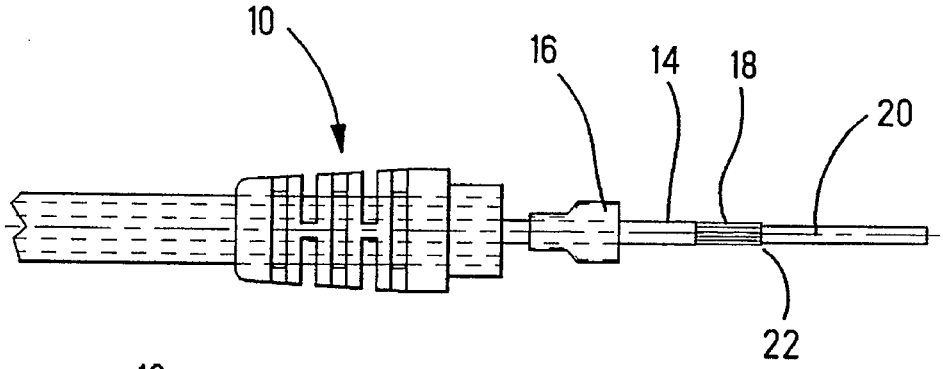
FIG. 2 is a side view of the cable shown in FIG. 1 stripped and the wire shield cut to length.
Figure 3:
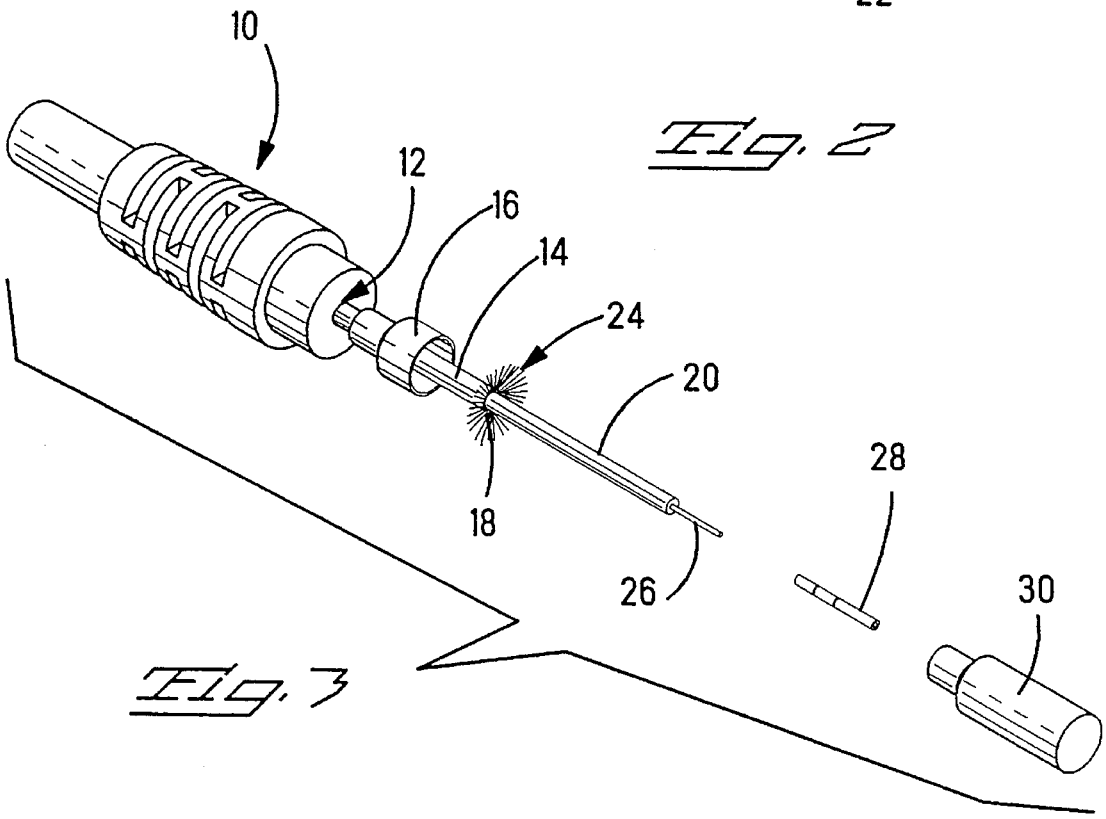
FIG. 3 is an isometric view of the cable shown in FIG. 2 with the wire shield splayed and center conductor stripped.

Before describing the tool of the present invention, a typical coax cable assembly will be describe and a method of terminating it. As shown in FIGS. 1, 2, and 3, a coax cable assembly 10 includes a cable 12 having an outer insulating jacket 14. A shield crimping ferrule 16 is slid over the cable 12 to the position shown in FIG. 2. A portion of the outer insulating jacket 14 is stripped back for a short distance exposing the underlying wire shield 18 that surrounds the center insulated conductor. A portion of the wire shield 18 is then cut away, leaving a length of wire shield and a portion of the center insulated conductor 20 extending outwardly from the cut end 22 of the wire shield. The wire shield 18 is then splayed radially outwardly to form a disk shape that is substantially perpendicular to the longitudinal axis of the cable 10, as shown at 24 in FIG. 3, the center conductor 26 stripped and terminated to a terminal 28, and then assembled into a ground shell 30. The ground shell 30 is then assembled to the ferrule 16 with the splayed wire shield 18 wedged therebetween, and crimped to complete the termination.

Figure 5:
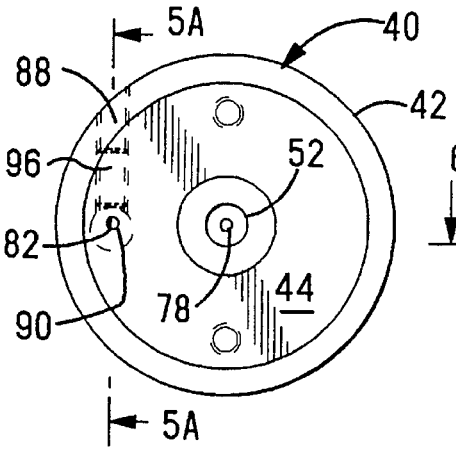
FIGS. 4 and 5 are side and end views, respectively, of a tool incorporating the teachings of the present invention.
Figure 4:
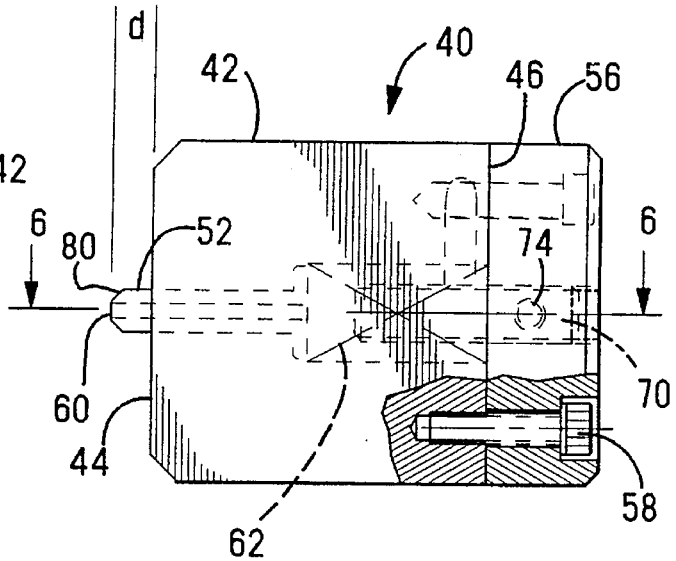
Figure 5A:
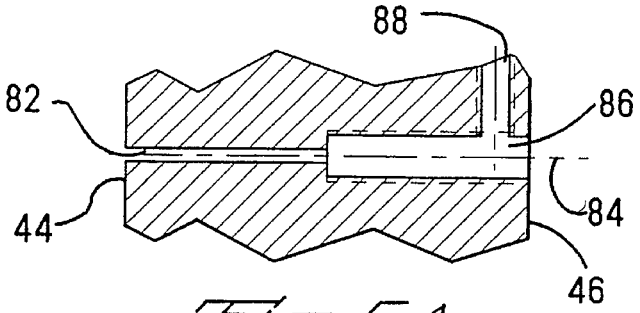
FIG. 5A is a partial cross-sectional view taken along the lines 5A—5A of FIG. 5.
Figure 6:
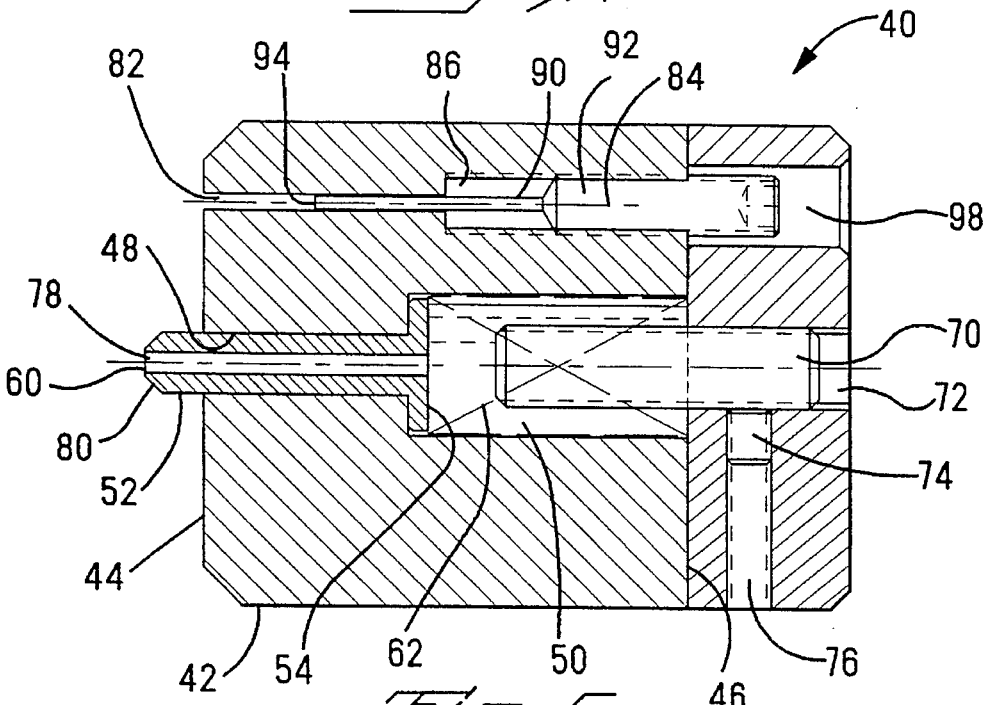
FIG. 6 is a cross-sectional view taken along the lines 6—6 in FIG. 4.
Figure 9:
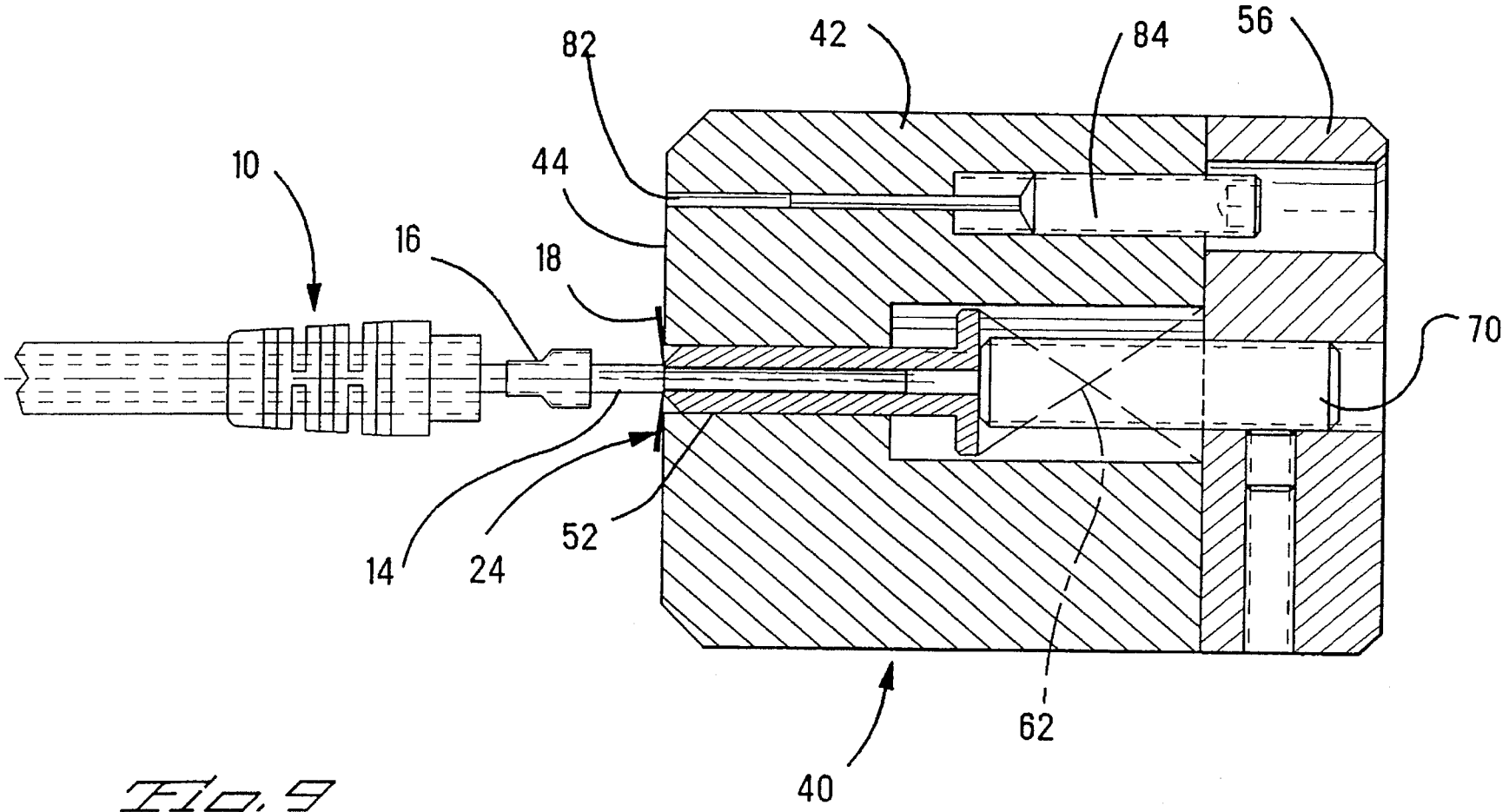

The splaying of the wire shield 18 is accomplished by means of a tool 40, shown in FIGS. 4, 5, and 6. The tool 40 includes a block 42 having a flat surface 44 and an opposite surface 46. A hole 48 is formed through the block intersecting the flat surface 44 and includes a counterbore 50 formed in the opposite surface 46. A pin 52 having an enlarged flat head 54 is disposed within the hole 48 with the head in the counterbore 50, as shown in FIG. 6. The pin 52 is a loose slip fit with the hole 48 so that the pin is free to move axially within the hole. A back plate 56 is attached to the surface 46 by means of two screws 58 that are threaded into the block 42, thereby covering the counterbore 50. A resilient member 62, a compression spring in the present example, is disposed within the counterbore between the back plate 56 and the head 54 of the pin 52 so that the head is urged against the left most end of the counterbore, as viewed in FIG. 6. This causes the end 60 of the pin 52 to extend outwardly from the flat surface 44 for a distance "d", as shown in FIG. 4, this being the first position of the pin. A stop screw 70 is threaded into a hole 72 in the back plate 56 in alignment with the pin 52. The stop screw extends into the counterbore 50 but is spaced from the head 54. The stop screw is positioned so that when the pin 52 is pushed further into the hole 48, against the counter urging of the spring 62, the head 54 abuttingly engages the end of the stop screw, thereby limiting further movement in that direction. At this point the pin 52 is in its second position and the end 60 of the pin is substantially flush with the flat surface 44, as shown in FIG. 9. The exact position of the end 60 with respect to the flat surface 44 may be adjusted by turning the stop screw 70 one way or the other. A set screw 74 is threaded into a hole 76 in the back plate 56 so that it intersects the hole 72 and is tightened against the stop screw 70 to secure it in place. As shown in FIG. 6, a hole 78 is axially formed through the pin 52 and is sized to easily receive the insulated center conductor 20 without too much lateral play. A bevel 80 is formed on the end 60 of the pin for guiding the partially splayed wire shield 18 outwardly, as will be explained below. Another hole 82, of similar diameter to the hole 78 and having an axis 84, is formed in the flat surface 44 to a depth that is about one half the thickness of the block 42. A threaded hole 86 is formed in the surface 46 coaxially with and intersecting the hole 82, as best seen in FIG. 5A. Another threaded hole 88 is formed in the block 42 at right angles to and intersecting the threaded hole 86. As best seen in FIG. 6, a stop pin 90 is disposed in the hole 82, the stop pin being pressed into a hole in a screw 92 so that it is coaxial with and carried by the screw. The screw 92 is threaded into the hole 86 so that the stop pin 90 can be adjusted further into the hole 82 or retracted therefrom by simply turning the screw 92 one way or the other. The screw 92 is adjusted so that the distance from the tip 94 of the stop pin 90 to the surface 44, as best seen in FIG. 6, is about 20 percent less that the distance from the end of the center conductor 20 to the cut end 22 of the wire shield 18, for a purpose that will be explained. The screw 92 is secured in place by means of a set screw 96 that is threaded into the hole 88 and tightened against the screw 92. A clearance hole 98 is formed in the back plate 56 in alignment with the axis 84, as shown in FIG. 6, to provide access to the screw 92 for adjustment purposes.

Figure 7:
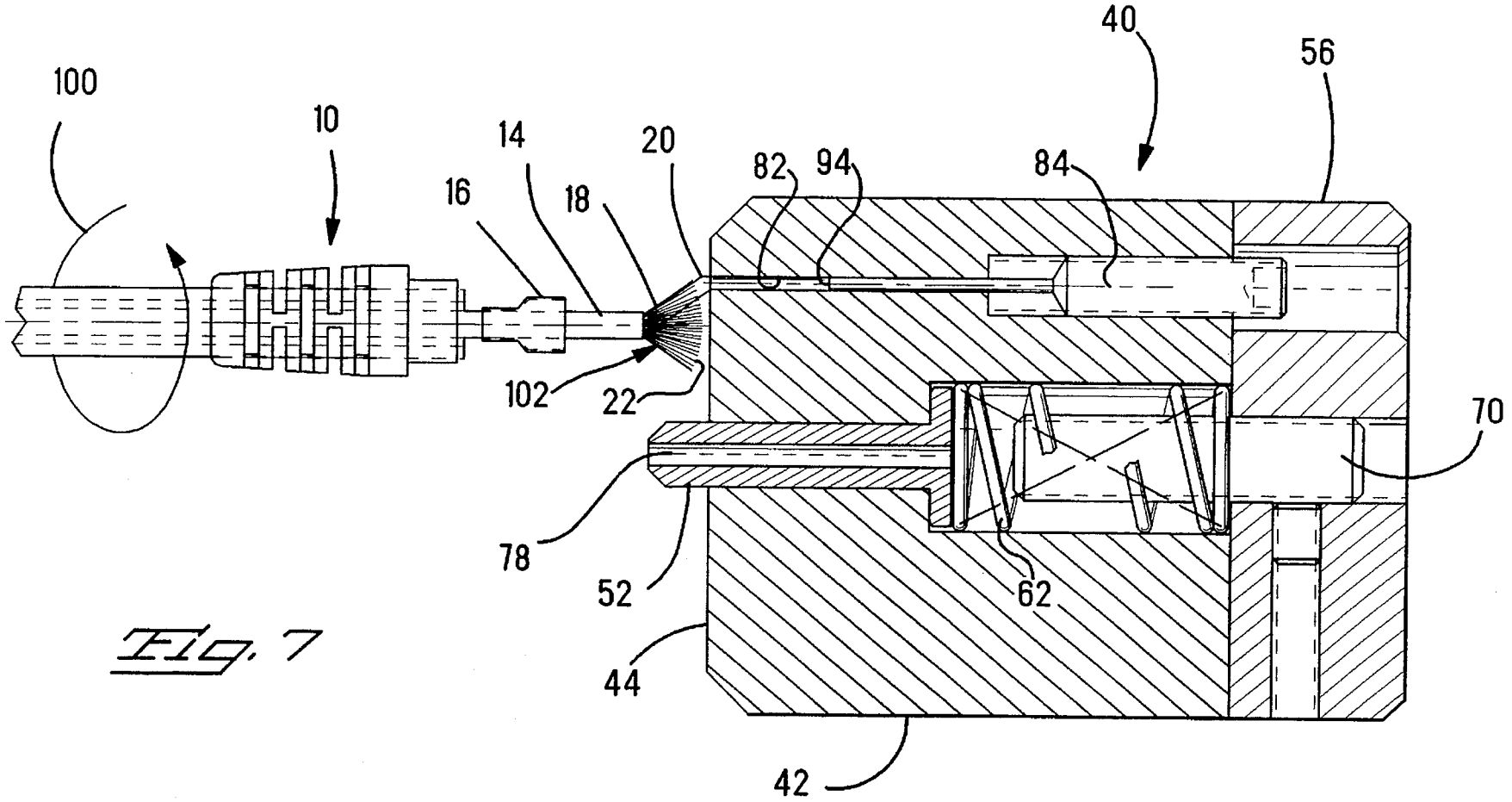
FIGS 7, 8 and 9 show the tool of FIG. 6 in various operational positions.
Figure 8:
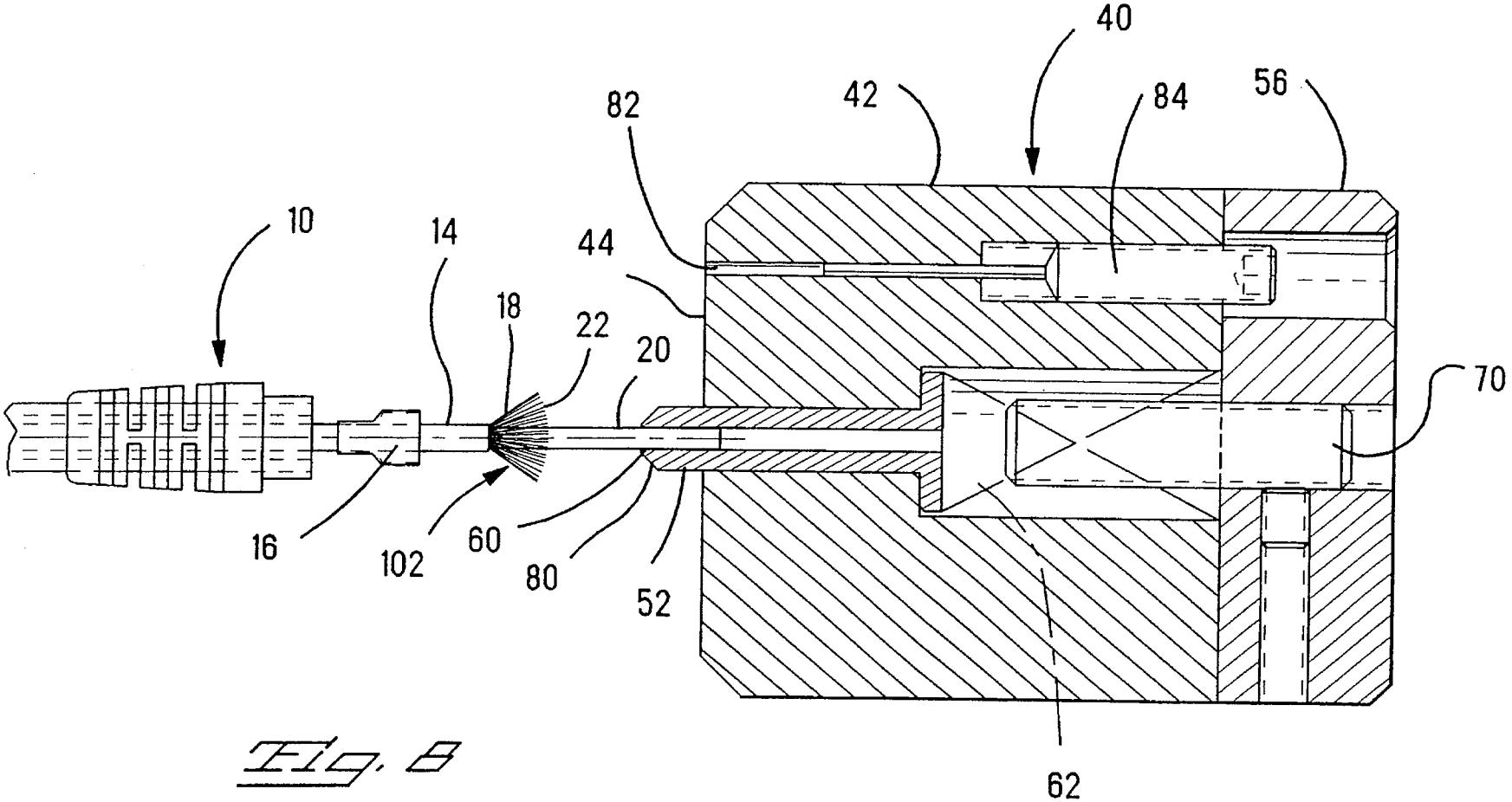

In operation, the cable assembly 10 is prepared as shown in FIG. 2 and as described above. As shown in FIG. 7, the end of the insulated center conductor 20 is inserted into the hole 82 until it bottoms against the tip 94, and the cable assembly 10 is shifted off center from the hole so that the longitudinal axis of the cable 14 is spaced from and approximately parallel to the axis 84 of the hole 82. The tool 40 is then held substantially stationary while the cable 14 is grasped close to the shield 18 and moved along an arcuate path, as indicated by the arrow 100 in FIG. 7, without rotating the cable about its axis. Alternatively, the cable 14 may be held substantially stationary while the tool 40 is moved along the arcuate path. During this movement the longitudinal axis of the cable 14 is maintained substantially parallel to the axis 84 and spaced from the hole 82. This movement of the cable along the arcuate path causes the cable to deflect the individual strands of the wire shield outwardly into a conical shape 102, as shown in FIG. 7. This completes the initial splaying of the wire shield 18. The position of the tip 94, and therefore the depth of the hole 82, is chosen so that the cut edge 22 of the wire shield 18 does not engage the flat surface 44 or any part of the tool 40 during the initial splaying operation. With the pin 52 in the first position, the end of the insulated center conductor 20 is inserted into the hole 78, as shown in FIG. 8. The cable assembly 10 is moved further along its axis toward the tool 40 so that the exposed portion of the center conductor 20 extends completely into the hole 78 and the bevel 80 engages and further splays the wire shield. The portion of the conical shape 102 of the wire shield 18 near the center conductor 20 then engages the end 60 of the pin 52 and begins to move it to the right into the block 42 against the urging of the compression spring 62, as viewed in FIGS. 8 and 9. As movement of the cable continues, the cut edge 22 of the partially splayed wire shield 18 engages the flat surface 44 and cams radially outwardly to form a disk shape 24, as described above and as shown in FIG. 9. The cable assembly 10 is then withdrawn from the tool 40 allowing the spring 62 to return the pin 52 to its first position, as shown in FIG. 7. The insulation of the insulated center conductor 20 is then stripped back to bare the center conductor 26. The final splaying of the wire shield into the disk 24 allows the stripping tool, not shown, to be positioned very close to the disk 24 so that the remaining insulation on the conductor 26 extending from the wire shield after stripping is relatively short, about 0.06 inch in the present example. This can be important in the case of certain connectors. The cable assembly 10 is now ready to attach the terminal 28 and ground shell 30, as shown in FIG. 3, in the usual manner.

An important advantage of the present invention is that the wire shield of coax cables are accurately and reliably splayed for subsequent termination to a connector ground shield. Splaying of the wire shield into a disk that is substantially perpendicular to the axis of the cable permits tool access for stripping the center conductor relatively close to the wire shield. The splaying is inexpensive and simple to perform, and is of repeatable high quality.

We claim:

1. A tool for splaying the wire shielding of a coax cable radially about its center conductor, wherein said cable has a prepared end stripped of insulation, comprising:

(a) a block having a flat surface and a first hole formed in said flat surface perpendicular thereto;

(b) a pin in said first hole arranged to slide therein from a first position where an end of said pin extends outwardly from said flat surface to a second position where said end of said pin is substantially flush with said flat surface, said pin having a second hole formed axially therein for receiving said center conductor; and (c) a resilient member in said first hole arranged for urging said pin into said first position, said block and said pin arranged so that upon moving said coax cable axially toward said pin, said pin being in said first position, and insertion of said center conductor into said second hole, said wire shield engages said end of said pin and splays outwardly, then said pin retracts into said block against the urging of said resilient member under continued movement of said cable until said wire shield engages said flat surface and is thereby splayed further, said pin then being in said second position.

2. The tool according to claim 1 wherein said end of said pin is beveled for deflecting said wire shielding into engagement with said flat surface.

3. The tool according to claim 1 wherein said first hole extends through said block to a second surface opposite said flat surface, said first hole being counterbored into said second surface and said resilient member being a compression spring disposed in said counterbore.

4. The tool according to claim 3 including a plate attached to said second surface covering said counterbore, and an adjusting screw threaded into said plate for engaging and limiting movement of said pin, said adjusting screw extending into said counterbore into abutting engagement with said pin only when said pin is in said second position.

5. The tool according to claim 1 including a third hole in said block sized for receiving said end of said cable for initial partial splaying of said wire shield, said third hole having a depth that prevents said wire shield from engaging said tool during said initial splaying, said third hole arranged so that upon insertion of said center conductor into said third hole, holding said block stationary, shifting said cable assembly out of axial alignment with said third hole, and moving said cable assembly along an arcuate path about said third hole, said wire shield is partially splayed.

6. The tool according to claim 5 including a stop pin in said third hole spaced from said flat surface and arranged so that said depth of said third hole is defined as the distance from said flat surface to said stop pin.

7. The tool according to claim 6 wherein said stop pin is attached to and coaxial with a screw and wherein said screw is threaded into a hole in said block that is coaxial with said third hole so that, upon turning said screw said stop pin is caused to move within said third hole toward or away from said flat surface.

8. In a method of preparing an end of a coax cable for termination, said cable having an outer insulating jacket, a wire shield, and a center insulated conductor, the steps of:

(a) removing said outer insulating jacket of said end of said cable for a first distance from said end;

(b) cutting said wire shield along a cut line a second distance from said end less than said first distance, a portion of said center insulated conductor of said cable extending from said cut line to said end;

(c) moving said cable and said portion of said end out of mutual axial alignment and inserting said portion into an opening in a tool;

(d) holding one of said cable and said tool stationary with respect to a first axis while moving the other of said cable and said tool along an arcuate path about said first axis; and then (e) inserting said portion axially into another opening in said tool until said tool engages and further plays said wire shield to form a disk that is substantially perpendicular to said cable.

9. The method according to claim 8 wherein step (d) includes holding said tool stationary while moving said cable along said arcuate path.

* * * * *